US008978829B2

(12) United States Patent
McCune et al.

(10) Patent No.: US 8,978,829 B2
(45) Date of Patent: Mar. 17, 2015

(54) TURBOMACHINE FLUID DELIVERY SYSTEM

(75) Inventors: Michael E. McCune, Colchester, CT (US); Denman H. James, Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 249 days.

(21) Appl. No.: 13/539,912

(22) Filed: Jul. 2, 2012

(65) Prior Publication Data

US 2014/0000721 A1 Jan. 2, 2014

(51) Int. Cl.
*F17D 3/00* (2006.01)

(52) U.S. Cl.
CPC ..... *F17D 3/00* (2013.01)
USPC ..... 184/104.1; 137/1; 137/565.01

(58) Field of Classification Search
USPC ..... 184/104.1; 137/1, 565.01
See application file for complete search history.

(56) References Cited

U.S. PATENT DOCUMENTS

| | | | | |
|---|---|---|---|---|
| 2,239,098 | A * | 4/1941 | Hunter | 137/38 |
| 2,373,360 | A * | 4/1945 | Walsh | 184/6.13 |
| 3,427,980 | A | 2/1969 | Jubb et al. | |
| 3,946,551 | A | 3/1976 | Linebrink et al. | |
| 4,245,465 | A | 1/1981 | Milo | |
| 4,891,934 | A * | 1/1990 | Huelster | 60/39.08 |
| 5,411,116 | A | 5/1995 | Kish et al. | |
| 6,250,894 | B1 | 6/2001 | Dyer et al. | |
| 6,463,819 | B1 * | 10/2002 | Rago | 184/6.2 |
| 6,758,656 | B2 | 7/2004 | Maier et al. | |
| 6,932,583 | B2 | 8/2005 | Niethammer | |
| 8,020,665 | B2 | 9/2011 | Sheridan et al. | |
| 8,230,974 | B2 * | 7/2012 | Parnin | 184/6.11 |
| 2002/0037231 | A1 | 3/2002 | Saiz | |
| 2006/0060425 | A1 * | 3/2006 | Richardson et al. | 184/55.1 |
| 2010/0028127 | A1 | 2/2010 | Cornet et al. | |
| 2010/0293919 | A1 | 11/2010 | Poisson et al. | |
| 2010/0294597 | A1 | 11/2010 | Parnin | |
| 2011/0217173 | A1 | 9/2011 | Mallada et al. | |
| 2011/0314830 | A1 | 12/2011 | Legare | |

FOREIGN PATENT DOCUMENTS

| | | |
|---|---|---|
| EP | 2559913 | 2/2013 |
| JP | 11-101103 | 4/1999 |

OTHER PUBLICATIONS

International Search Report and Written Opinion for International Application No. PCT/US2013/047008 completed on Sep. 10, 2013.
International Preliminary Report on Patentability for PCT Application No. PCT/US2013/047008, mailed Jan. 15, 2015.

* cited by examiner

*Primary Examiner* — William A Rivera
*Assistant Examiner* — Michael Riegelman
(74) *Attorney, Agent, or Firm* — Carlson, Gaskey & Olds, P.C.

(57) ABSTRACT

An exemplary system for delivering a turbomachine fluid to a supplied area is a pump configured to draw fluid from both a first container and a second container when operating in both a positive g-force environment and a negative g-force environment. The fluid from the first container in a positive g-force environment is a mixture of air and oil, and the fluid from the first container in a negative g-force environment is primarily oil.

14 Claims, 4 Drawing Sheets

100

| ENGINE ENVIRONMENT | FLUID FROM FIRST CONTAINER | FLUID FROM SECOND CONTAINER |
|---|---|---|
| POSITIVE G-FORCE | MIXTURE OF AIR + OIL | MIXTURE OF AIR + OIL |
| ZERO G-FORCE | MIXTURE OF AIR + OIL | AIR |
| NEGATIVE G-FORCE | OIL | AIR |
| WINDMILLING | AIR | OIL |

TURBOMACHINE FLUID DELIVERY SYSTEM

BACKGROUND

This disclosure relates generally to a fluid delivery system and, more particularly, to a fluid delivery system for controlling turbomachine fluid flow in positive and negative g-force flight environments.

Turbomachines, such as gas turbine engines, typically include a fan section, a compression section, a combustion section, and a turbine section. Turbomachines may employ a geared architecture connecting portions of the compression section to the fan section.

Turbomachines may be used to propel an aircraft in flight, for example. The g-force acting on the turbomachine is typically positive when the aircraft is in flight. Occasionally, the g-force acting on the turbomachine is negative when the aircraft is in flight. Some areas of the turbomachine require a relatively constant supply of lubricant. These areas must receive lubricant when positive g-forces act on the turbomachine and when negative g-forces act on the turbomachine.

SUMMARY

A system for delivering a turbomachine fluid to a supplied area according to an exemplary aspect of the present disclosure includes, among other things, a pump configured to draw fluid from both a first container and a second container when operating in both a positive g-force environment and a negative g-force environment. The fluid from the first container in a positive g-force environment is a mixture of air and oil, and the fluid from the first container in a negative g-force environment is primarily oil.

In a further non-limiting embodiment of the foregoing system, the fluid from the second container in a positive g-force environment may be a mixture of oil and air, and the fluid from the second container in a negative g-force environment may be primarily air.

In a further non-limiting embodiment of either of the foregoing systems, the fluid from the second container in a zero g-force in the environment may be primarily air, and the fluid from the second container in a negative g-force environment may be primarily air.

In a further non-limiting embodiment of any of the foregoing systems, the fluid from the first container when the turbomachine is not operating may be primarily air, and the fluid from the second container when the turbomachine is not operating may be primarily oil.

In a further non-limiting embodiment of any of the foregoing systems, the pump may be a two-stage pump.

In a further non-limiting embodiment of any of the foregoing systems, the pump is a gear pump.

In a further non-limiting embodiment of any of the foregoing systems, the pump may communicate a mixture of fluid from the first container and the second container to a geared architecture of a turbomachine.

In a further non-limiting embodiment of any of the foregoing systems, the pump may communicate fluid to a journal bearing of the geared architecture.

In a further non-limiting embodiment of any of the foregoing systems, the first container may be at an elevation higher than the second container.

In a further non-limiting embodiment of any of the foregoing systems, the first container may be an auxiliary lubricant tank, and the second container may be a sump associated with the auxiliary lubricant tank.

A turbomachine fluid delivery system according to an exemplary aspect of the present disclosure includes, among other things, a first turbomachine fluid container, a second turbomachine fluid container, a supplied area, and a pump configured to move a flow of a turbomachine fluid to the supplied area. The first and second turbomachine fluid containers together provide the flow to the pump in both a positive g-force environment and a negative g-force environment.

In a further non-limiting embodiment of the foregoing turbomachine fluid delivery system, the turbomachine fluid from the first turbomachine fluid container when operating in a positive g-force environment may be a mixture of air and oil, and the turbomachine fluid from the first turbomachine fluid container in a negative g-force environment may be primarily oil.

In a further non-limiting embodiment of either of the foregoing turbomachine fluid delivery systems, the pump may receive primarily oil from both the first turbomachine fluid container and the second turbomachine fluid container when operating in a positive g-force environment, primarily oil from the first container when operating in a negative g-force environment, and primarily oil from the second container when the turbomachine is not operating.

In a further non-limiting embodiment of any of the foregoing turbomachine fluid delivery systems, the supplied area may be a geared architecture of a turbomachine.

In a further non-limiting embodiment of any of the foregoing turbomachine fluid delivery systems, the supplied area may be a journal bearing of the geared architecture.

In a further non-limiting embodiment of any of the foregoing turbomachine fluid delivery systems, the first turbomachine fluid container may be an auxiliary lubricant tank, and the second turbomachine fluid container may be a sump associated with the auxiliary lubricant tank.

A method of controlling a turbomachine fluid flow according to another exemplary aspect of the present disclosure includes, among other things, communicating a turbomachine fluid to a supplied area when operating in both a positive g-force environment and a negative g-force environment. The communicated turbomachine fluid is a combination of fluid from both a first turbomachine fluid container and a second turbomachine fluid container In a further non-limiting embodiment of the foregoing method of controlling a turbomachine fluid flow, the first and second turbomachine fluid containers may both provide primarily oil to a pump when operating in the positive g-force environment, and the first container may provide primarily oil to the pump when operating in the negative g-force environment.

In a further non-limiting embodiment of either of the foregoing methods of controlling a turbomachine fluid flow, the supplied area may be a geared architecture of a turbomachine.

In a further non-limiting embodiment of any of the foregoing methods of controlling a turbomachine fluid flow, the first container may be an auxiliary lubricant tank, and the second container may be a sump associated with the auxiliary lubricant tank.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
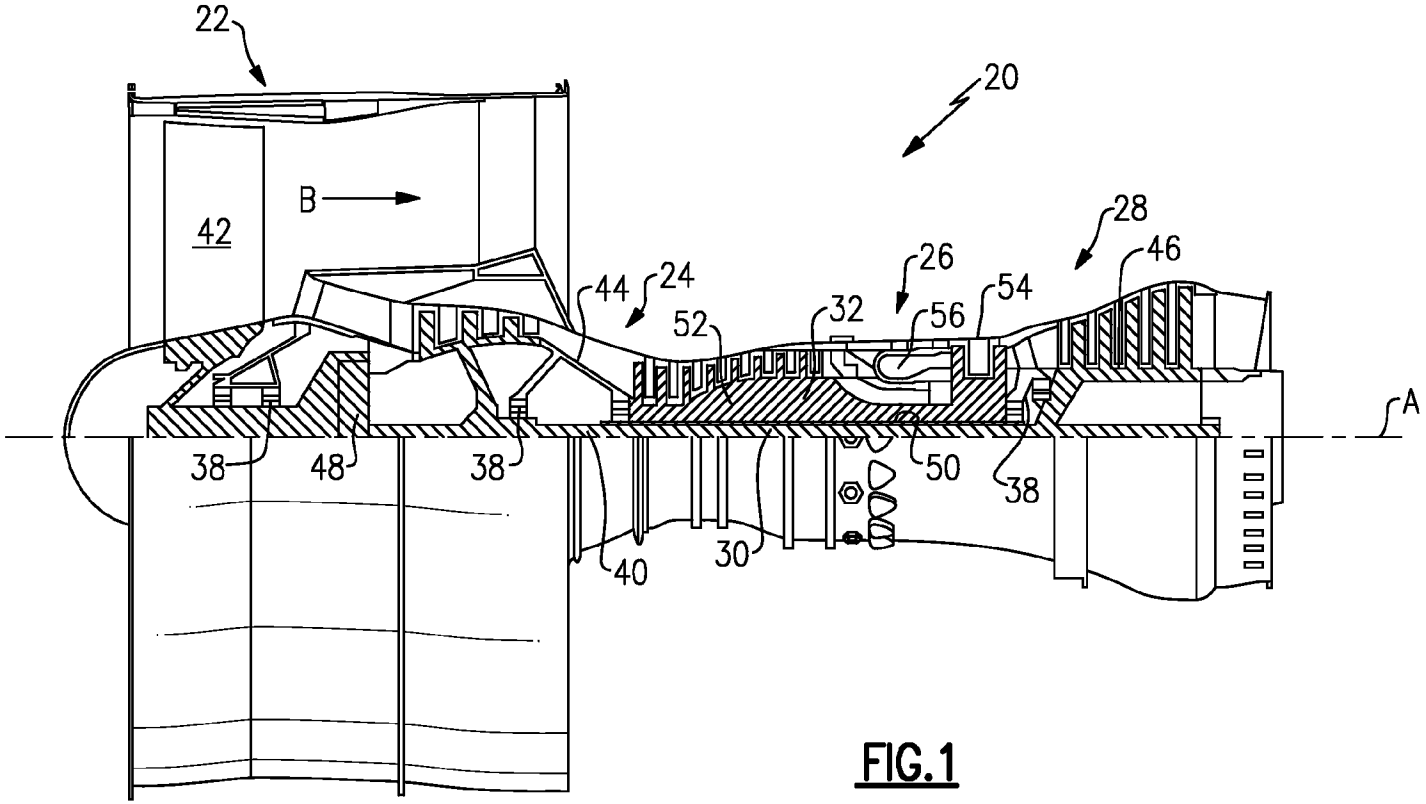
FIG. 1 shows a schematic view of an example turbomachine.

FIG. 1 schematically illustrates an example turbomachine, which is a gas turbine engine 20 in this example. The gas turbine engine 20 is a two-spool turbofan gas turbine engine that generally includes a fan section 22, a compression section 24, a combustion section 26, and a turbine section 28.

Although depicted as a two-spool turbofan gas turbine engine in the disclosed non-limiting embodiment, it should be understood that the concepts described herein are not limited to use with turbofans. That is, the teachings may be applied to other types of turbomachines and turbine engines including three-spool architectures. Further, the concepts described herein could be used in environments other than a turbomachine environment and in applications other than aerospace applications, such as automotive applications.

In the example engine 20, flow moves from the fan section 22 to a bypass flowpath. Flow from the bypass flowpath generates forward thrust. The compression section 24 drives air along the core flowpath. Compressed air from the compression section 24 communicates through the combustion section 26. The products of combustion expand through the turbine section 28.

The example engine 20 generally includes a low-speed spool 30 and a high-speed spool 32 mounted for rotation about an engine central axis A. The low-speed spool 30 and the high-speed spool 32 are rotatably supported by several bearing systems 38. It should be understood that various bearing systems 38 at various locations may alternatively, or additionally, be provided.

The low-speed spool 30 generally includes a shaft 40 that interconnects a fan 42, a low-pressure compressor 44, and a low-pressure turbine 46. The shaft 40 is connected to the fan 42 through a geared architecture 48 to drive the fan 42 at a lower speed than the low-speed spool 30.

The high-speed spool 32 includes a shaft 50 that interconnects a high-pressure compressor 52 and high-pressure turbine 54.

The shaft 40 and the shaft 50 are concentric and rotate via bearing systems 38 about the engine central longitudinal axis A, which is collinear with the longitudinal axes of the shaft 40 and the shaft 50.

The combustion section 26 includes a circumferentially distributed array of combustors 56 generally arranged axially between the high-pressure compressor 52 and the high-pressure turbine 54.

In some non-limiting examples, the engine 20 is a high-bypass geared aircraft engine. In a further example, the engine 20 bypass ratio is greater than about six (6 to 1).

The geared architecture 48 of the example engine 20 includes an epicyclic gear train, such as a star/planetary gear system or other gear system. The example epicyclic gear train has a gear reduction ratio of greater than about 2.3 (2.3 to 1).

The low-pressure turbine 46 pressure ratio is pressure measured prior to inlet of low-pressure turbine 46 as related to the pressure at the outlet of the low-pressure turbine 46 prior to an exhaust nozzle of the engine 20. In one non-limiting embodiment, the bypass ratio of the engine 20 is greater than about ten (10 to 1), the fan diameter is significantly larger than that of the low pressure compressor 44, and the low-pressure turbine 46 has a pressure ratio that is greater than about 5 (5 to 1). The geared architecture 48 of this embodiment is an epicyclic gear train with a gear reduction ratio of greater than about 2.3 (2.3 to 1). It should be understood, however, that the above parameters are only exemplary of one embodiment of a geared architecture engine and that the present disclosure is applicable to other gas turbine engines including direct drive turbofans.

In this embodiment of the example engine 20, a significant amount of thrust is provided by the bypass flow B due to the high bypass ratio. The fan section 22 of the engine 20 is designed for a particular flight condition—typically cruise at about 0.8 Mach and about 35,000 feet. This flight condition, with the engine 20 at its best fuel consumption, is also known as "Bucket Cruise" Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example engine 20 is less than 1.45 (1.45 to 1).

Low Corrected Fan Tip Speed is the actual fan tip speed divided by an industry standard temperature correction of Temperature divided by 518.7^0.5. The Temperature represents the ambient temperature in degrees Rankine. The Low Corrected Fan Tip Speed according to one non-limiting embodiment of the example engine 20 is less than about 1150 fps (351 m/s).

Figure 2:
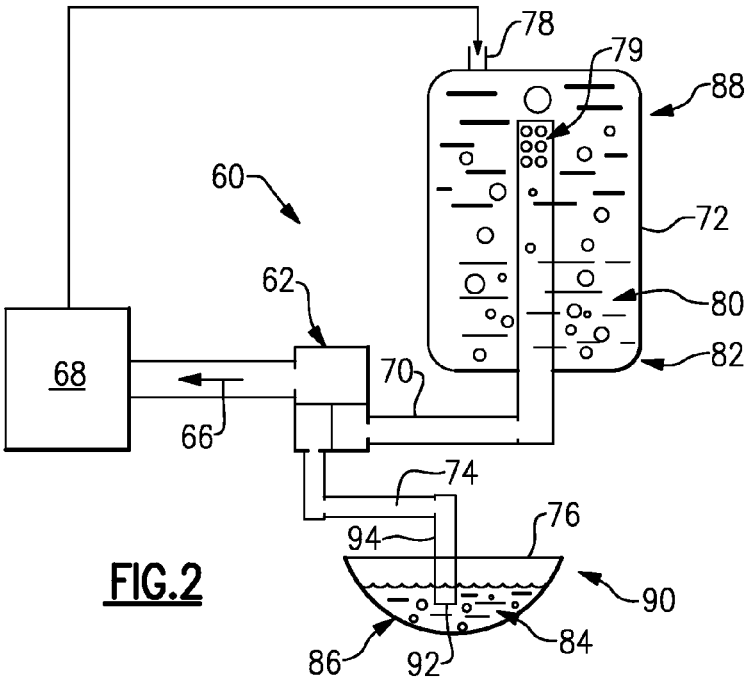
FIG. 2 shows a highly schematic view of an example turbomachine fluid delivery system in a positive g-force environment.

Referring to FIG. 2 with continuing reference to FIG. 1, an example turbomachine fluid delivery system 60 includes a pump 62 that is used to deliver a turbomachine fluid 66, for example, lubricant, to a supplied area 68. The turbomachine fluid 66 from the pump 62 is a mixture of fluid moved along a conduit 70 from a first container 72, and fluid moved along a conduit 74 from a second container 76. The mixture of fluid is a mixture of lubricant, such as oil, and air in this example.

The first container 72, in this example, is supplied with fluid from a gutter system associated with the geared architecture 48 of the engine 20. Other than one or more inlets 78 to the first container 72 and one or more outlets 79 (to the conduit 70), the first container 72 is enclosed. The example outlets 79 are provided in a vertical top portion of the conduit 70.

In this example, the operating engine 20 sprays fluid into the gutter and the first container 72, which pressurizes the first container 72, and keeps the first container 72 filled with a fluid 80. The fluid 80 is typically a foamy mix of air and oil. The elevation of the first container 72 is higher than the elevation of the second container 76.

The engine 20 typically operates in a positive g-force environment when an aircraft propelled by the engine 20 is in flight. In the positive g-force environment, positive g-forces act on the engine 20. In positive g-force environments, the positive g-forces cause the fluid 80 filling the first container 72 to collect near a vertical bottom 82 of the first container 72.

The first container 72 is typically completely filled with the fluid 80. The positive g-forces also cause a fluid 84 to collect at a vertical bottom 86 of the second container 76. As used herein, elevation and vertical relationships refer to distance or height above a reference height when the engine 20 is on level ground or in straight and level flight.

Figure 3:
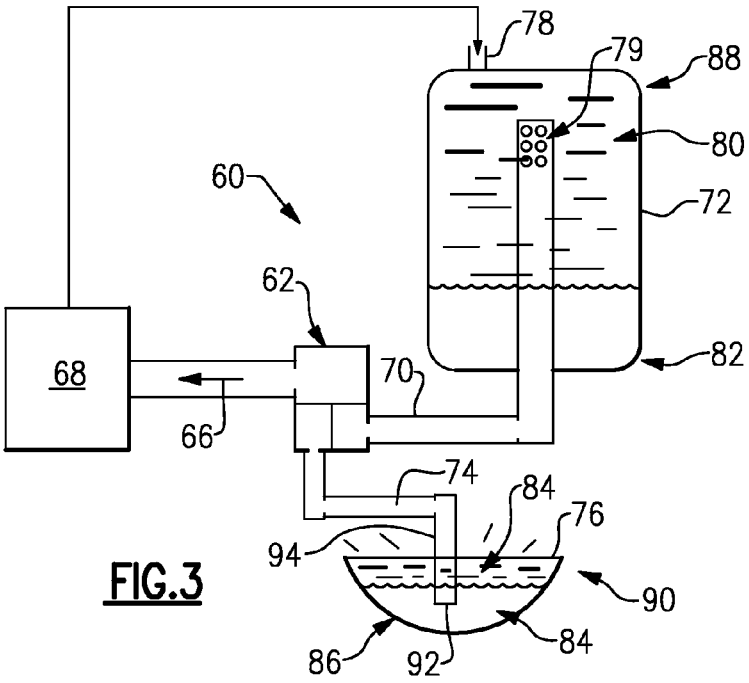
FIG. 3 shows a highly schematic view of the example turbomachine fluid delivery system in a negative g-force environment.

Referring now to FIG. 3, the engine 20 occasionally may operate in a negative g-force environment when an aircraft propelled by the engine 20 is in flight. In the negative g-force environment, negative g-forces act on the engine 20. In negative g-force environments, the negative g-forces cause the fluid 80 within the first container 72 to be forced upward toward a vertical top 88 of the first container 72. The negative g-forces also cause the fluid 80 to be forced upward to a vertical top 90 of the second container 76. Velocity of the incoming fluid 80 to inlets 78 in the negative g-force environment prevents the fluid 80 within first container 78 from backflowing out inlet 78.

In this example, the supplied area 68 is the geared architecture 48 of the engine 20, and specifically a journal bearing associated with the geared architecture 48. The journal bearings require the turbomachine fluid 66 in both the positive g-force environment and the negative g-force environment. The supplied area 68 may be other areas of the engine 20 in other examples.

The example pump 62 is a two-stage, rotary pump, which may be considered a constant volume pump. The pump 62 many include two separate gear pumps driven by the same rotating shaft, which is powered by the rotating engine 20. One of the gear pumps may move fluid from the first container 72 along the conduit 70, and the other of the gear pumps may move fluid from the second container 76 along the conduit 74. The example pump 62 pressurizes the fluid 80 and the fluid 84. The fluids 80 and 84 are then mixed near the exit of pump 62. The pump 62 may have other numbers of stages in other examples.

In this example, in the positive g-force environment (FIG. 2), the fluid 80 drawn from the first container 72 is a mixture of oil and air. Also, in the positive g-force environment, the fluid 84 drawn from the second container 76 is a mixture of oil and air. The pump 62 compresses any air within the turbomachine fluid 66 so that the turbomachine fluid 66 delivered to the supplied area 68 is primarily oil. Again, the turbomachine fluid 66 delivered to the supplied area 68 is a mixture of the fluid 80 drawn from the first container 72 and the fluid 84 drawn from the second container 76.

In this example, in the negative g-force environment, the fluid 80 drawn from the first container 72 is primarily oil. The negative g-forces cause most of the air within the first container 72 to separate from the oil within the first container 72. Also, in the negative g-force environment, the fluid 84 drawn from the second container 76 is primarily air as the oil has moved vertically upwards past an inlet 92 pulling fluid 84 from the second container 76.

The second container 76 is a sump having an open top which collects overflow from the first container 72. The inlet 92 is provided within a dipper tube 94 of the conduit 74.

Figure 4:
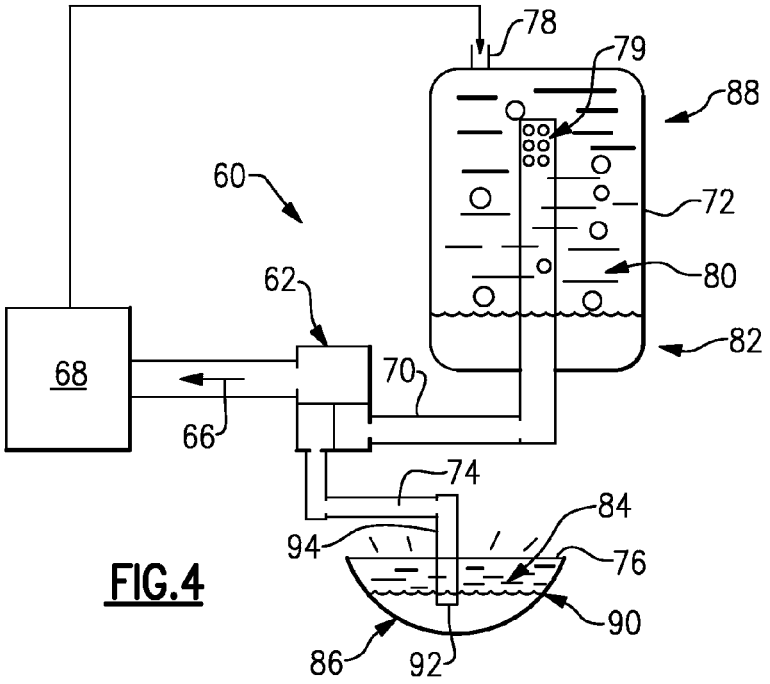
FIG. 4 shows a highly schematic view of the example turbomachine fluid delivery system in a zero g-force environment.

FIG. 4 shows the turbomachine fluid delivery system 60 in a zero g-force environment, which is the transition between the positive and negative g-force environments. In the zero g-force environment, the fluid 80 from the first container 72 is a mixture of oil and air, and the fluid from the second container 76 is primarily air. In the zero g-force environment, the fluid may move out of the second container 76 through the open top, which causes the inlet 92 to draw the air, rather than oil or a mixture of air and oil from the second container 76.

Figure 5:
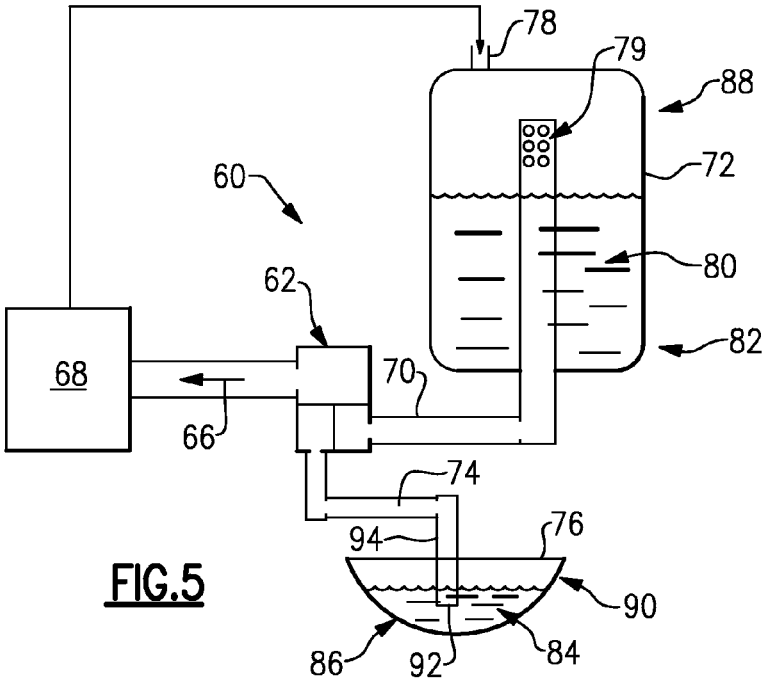
FIG. 5 shows a highly schematic view of the example turbomachine fluid delivery system in a windmilling environment.

FIG. 5 shows the turbomachine fluid delivery system 60 in an environment when the engine 20 is windmilling in the air during flight. The g-force is positive in this example, when the engine 20 is windmilling. The pump 62 is driven from the fan 42 when the engine 20 is windmilling. When the engine 20 is windmilling in the positive g-force environment, the fluid 80 from the first container 72 is primarily air as the engine 20 is not rotating fast enough to support filling the first container 72. The fluid 84 from the second container 76 is primarily oil. A negative g-force environment is typically ten seconds or less in duration. When the engine 20 is windmilling in a negative g-force environment, the loads on bearings and other lubricated structures are typically low enough that an oil interruption for ten seconds will not cause a failure.

Figures 6, 7:
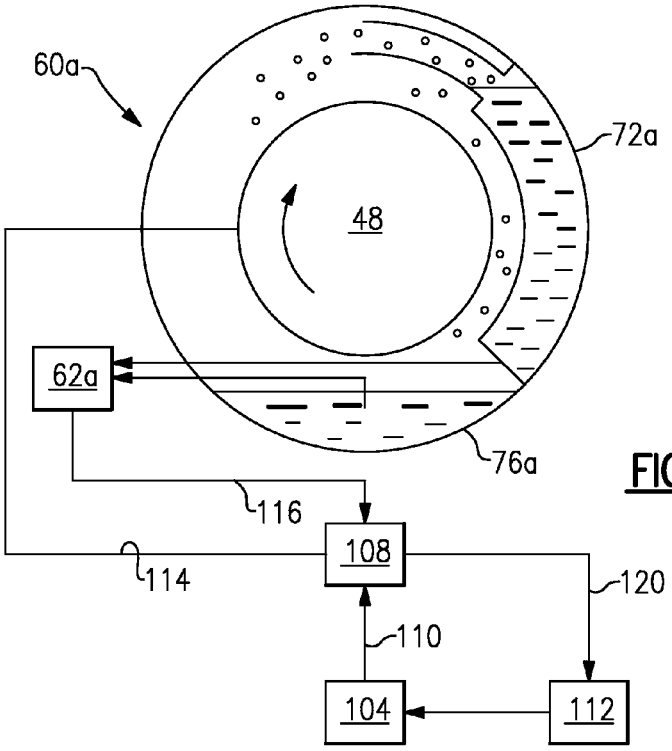
FIG. 6 is a summary table showing how fluid is delivered in different flight environments.
FIG. 7 shows a partially schematic view of another example fluid delivery system in a positive g-force environment.

Referring to FIG. 6 with continuing reference to FIGS. 2-5, a table 100 summarizes the fluid provided from the first container 72 and the second container 76 at the various flight environments discussed above.

FIG. 7 shows a more detailed schematic view of another example turbomachine fluid delivery system 60*a* suitable for use in the engine 20 (FIG. 1). As shown, a first container 72*a* may be an arcuate container arranged about the fan drive gear system of the geared architecture 48. A second container 76*a* is vertically below the first container 72*a*. The second container 72*a* is a sump that collects overflow from a gutter feed of the fan drive gear system. The overflow is fluid that does not enter the first container 72*a*.

An engine pump 104 supplies lubricant to a journal oil shuttle valve 108 along a path 110. The engine pump 104 draws the lubricant from a main engine tank 112. The lubricant from the path 110 then moves to the geared architecture 48 along a path 114.

A two-stage pump 62*a* also supplies a lubricant to the journal oil shuttle valve 108 along a path 116. The lubricant move along the path 116 is lubricant from the first container 72*a* and the second container 76*a*.

The journal oil shuttle valve 108 delivers the lubricant from the path 116 to the main engine tank 112 along the path 120 when the engine 20 is operating in the positive g-force environment. That is, when the engine 20 is operating in the positive g-force environment, the lubricant from the pump 62*a* is recirculated to the main engine tank 112.

When the engine 20 is operating in a zero g-force environment, a negative g-force environment, or a windmilling environment, the journal oil shuttle valve 108 delivers lubricant from the path 116 directly to the geared architecture 48 along the path 114. That is, when the engine 20 is not operating in a positive g-force environment, the journal oil shuttle valve 108 bypasses the main engine tank 112 and delivers lubricant from the path 116 directly to the geared architecture 48.

A feature of the disclosed examples is a system having substantially no latent failure modes due to valves controlling flow within the containers.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A system for delivering a turbomachine fluid to a supplied area, comprising:

a pump configured to draw fluid from both a first container and a second container when operating in both a positive g-force environment and a negative g-force environment, wherein the fluid from the first container in the positive g-force environment is a mixture of air and oil, and the fluid from the first container in the negative g-force environment consists essentially of oil and contains less air than the fluid drawn from the first container when operating in the positive g-force environment, wherein the fluid from the second container in the positive g-force environment is a mixture of oil and air, and the fluid from the second container in the negative g-force environment consists essentially of air and contains less oil than the fluid drawn from the second container when operating in the positive g-force environment.

2. The system of claim 1, wherein the fluid from the second container in a zero g-force in the environment is primarily air, and the fluid from the second container in the negative g-force environment is primarily air.

3. The system of claim 1, wherein the fluid from the first container when the turbomachine is not operating is primarily air, and the fluid from the second container when the turbomachine is not operating is primarily oil.

4. The system of claim 1, wherein the pump is a two-stage pump.

5. The system of claim 1, wherein the pump is a gear pump.

6. The system of claim 1, wherein the pump communicates a mixture of fluid from the first container and the second container to a geared architecture of a turbomachine.

7. The system of claim 6, wherein the pump communicates fluid to a journal bearing of the geared architecture.

8. The system of claim 1, wherein the first container is at an elevation higher than the second container.

9. The system of claim 1, wherein the first container is an auxiliary lubricant tank, and the second container is a sump associated with the auxiliary lubricant tank.

10. The turbomachine fluid delivery system of claim 9, wherein the supplied area is a geared architecture of a turbomachine.

11. The turbomachine fluid delivery system of claim 10, wherein the supplied area is a journal bearing of the geared architecture.

12. A turbomachine fluid delivery system, comprising:

a first turbomachine fluid container;

a second turbomachine fluid container;

a supplied area; and a pump configured to move a flow of a turbomachine fluid to the supplied area, the first and second turbomachine fluid containers together providing the flow to the pump in both a positive g-force environment and a negative g-force environment, wherein the turbomachine fluid from the first turbomachine fluid container when operating in the positive g-force environment is a mixture of air and oil, and the turbomachine fluid from the first turbomachine fluid container in the negative g-force environment consists essentially of oil and contains less air than the fluid drawn from the first turbomachine fluid container when operating in the positive g-force environment, wherein the fluid from the second turbomachine fluid container in the positive g-force environment is a mixture of oil and air, and the fluid from the second turbomachine fluid container in the negative g-force environment consists essentially of air and contains less oil than the fluid drawn from the second turbomachine fluid container when operating in the positive g-force environment.

13. The turbomachine fluid delivery system of claim 12, wherein the pump receives primarily oil from both the first turbomachine fluid container and the second turbomachine fluid container when operating in the positive g-force environment, primarily oil from the first container when operating in the negative g-force environment, and primarily oil from the second container when the turbomachine is not operating.

14. The turbomachine fluid delivery system of claim 12, wherein the first turbomachine fluid container is an auxiliary lubricant tank, and the second turbomachine fluid container is a sump associated with the auxiliary lubricant tank.

* * * * *